US005574258A

United States Patent [19]

Blonder

[11] Patent Number: 5,574,258

[45] Date of Patent: Nov. 12, 1996

[54] HEAT-SHRINK CRIMPING DEVICE AND METHOD

[75] Inventor: Greg E. Blonder, Summit, N.J.

[73] Assignee: Lucent Technologies Inc., Murray Hill, N.J.

[21] Appl. No.: 363,152

[22] Filed: Dec. 23, 1994

[51] Int. Cl.[6] ..... H01R 4/02

[52] U.S. Cl. ..... 174/77 R; 174/84 R; 174/87; 156/49

[58] Field of Search ..... 174/84 R, 87, 174/77 R, 76; 156/49

[56] References Cited

U.S. PATENT DOCUMENTS

| | | | |
|---|---|---|---|
| 4,287,386 | 9/1981 | Scahill et al. | 174/76 |
| 4,654,473 | 3/1987 | Roux et al. | 174/84 R |
| 4,693,767 | 9/1987 | Grzanna et al. | 156/49 X |
| 4,883,925 | 11/1989 | Graf | 174/84 R |
| 4,963,698 | 10/1990 | Chang et al. | 174/77 R |
| 5,210,376 | 5/1993 | Caviar | 174/87 |
| 5,221,815 | 6/1993 | Bostock et al. | 174/84 R |
| 5,418,332 | 5/1995 | Moncrieff | 174/115 X |

*Primary Examiner*—Peter S. Wong
*Assistant Examiner*—Chau N. Nguyen

[57] ABSTRACT

In order to establish a low-electrical resistance between two wires, a heat-shrinkable hollow tube is prepared. Three or more small-diameter conductors are attached to the inner surface of the hollow tube, such as by use of an epoxy adhesive. These conductors run parallel to the axis of the tube along its entire length. Each of the two wires is inserted into an opposite end of the tube. The tube is then heated to a sufficient temperature, such that when it cools it collapses and grasps both of the wires firmly, whereby the resulting electrical conductance between them (aided by the conductors) is enhanced.

19 Claims, 2 Drawing Sheets

HEAT-SHRINK CRIMPING DEVICE AND METHOD

FIELD OF THE INVENTION

This invention relates to devices using heat-shrinkable tubes for establishing low-electrical-resistance connections between wires, and to methods for establishing such connections.

BACKGROUND OF INVENTION

In order to establish low electrical-resistance connections (i.e., good electrical connection, high electrical conductance) between wires, the prior art has taught a variety of devices and methods. For example, one well-known method involves using a crimping tool for mechanically crimping together a pair of wires at room temperature. This method, however, is difficult to perform in an environment where physical access to the wires with the crimping tool is not easy, such as in tight spaces ("close quarters") of relatively small electronic devices. For another example, soldering the wires together requires heating them while their ends are overlapping each other. This heating typically requires a temperature of at least approximately 360° F. (=182° C.). Such a temperature can damage not only devices to which the wires are already connected at their other ends (because of the thermal conductance of the wires) but also devices that are present nearby.

Therefore, it would be desirable to have a device and a method for connecting a pair of wires together that mitigates some or all of the problems of prior art.

SUMMARY OF INVENTION

In a specific embodiment this invention involves a heat-shrinkable hollow tube having an inner surface to which is attached at least one, preferably at least three, conductors. The tube is typically cylindrical in shape. Each of the conductors advantageously runs substantially parallel to the axis of the tube, typically along substantially the entire length of the tube. Each of two wires to be connected together is inserted into an opposite (open) end of the tube, whereby the (near) ends of the wires within the tube either abut or nearly abut each other, or overlap each other. The heat-shrinkable hollow tube is then heated to a sufficiently high temperature whereby, on cooling, the inner diameter of the tube is reduced and hence the tube forces the conductors to grasp the two wires firmly. In this way, (even if the wires do not overlap) the wires make good electrical connection with each other via the conductors. Alternatively, if the wires overlap, they make good electrical connection with each other not only through the conductors but also directly. Also, both of the wires can be inserted into the same open end of the hollow tube—in which case advantageously the other end of the heat-shrinkable tube is closed (instead of being open) and contains a metallic plug thereat connecting the conductors together and hence connecting the wires together (via the conductors and the plug) with a lower electrical resistance.

The fact that the conductor(s) advantageously run(s) substantially parallel to the axis of the tube enables multiple points of contact between the conductor(s) and the wires, whereby electrical resistance between the wires via the conductor(s) is reduced.

In another specific embodiment, the invention involves the heat-shrinkable hollow tube itself with one of more conductors attached to its inner surface. Advantageously the conductors run substantially parallel to the axis of the tube. The tube, together with the conductors thus attached, can then be cut into smaller pieces. Each wire of a separate pair of wires is inserted into opposite ends of one these pieces, followed by heating as described above.

Only for the sake of clarity none of the drawings is to any scale.

DETAILED DESCRIPTION

Figure 1:
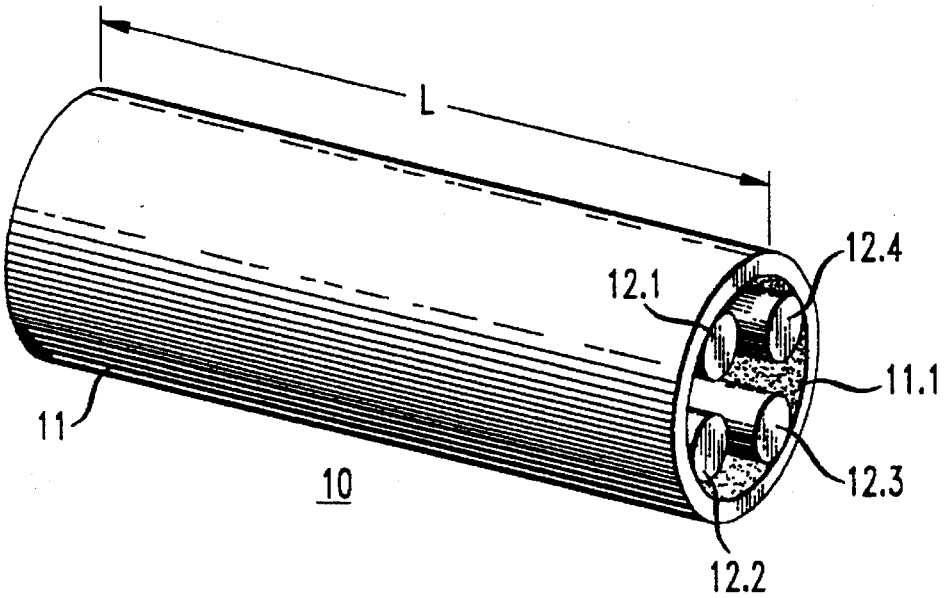
FIG. 1 shows a perspective view of a heat-shrink crimping device for connecting a pair of wires together, in accordance with a specific embodiment of the invention.

Turning to FIG. 1, a heat-shrink crimping device 10 includes a hollow tube 11 in the form of a hollow circular cylinder made of a heat-shrinkable material. The tube 11 need not be circular, but can be elliptical, oval, square, rectangular, or other shapes—or it can have different ones of these shapes at various locations along the length L of the device 10. In other words, any long hollow tube of heat shrinkable material will do for the tube 11. At any rate, the tube 11 has an inner surface 11.1. Four conductors 12.1, 12.2, 12.3, and 12.4 (hereinafter, "12.1–12.4") are attached to this inner surface 11.1 of the hollow tube 11. The cross section of each of the conductors 12.1–12.4 typically is a solid circular cylinder. Typically an epoxy adhesive is used for this attachment purpose: the epoxy is applied to the inner surface 11.1 and is partially set to a tacky state, and the conductors 12.1–12.4 are inserted into the tube 11 and are adhered to its inner surface 11.1. Alternatively, the attachment is achieved by heating either the conductors 12.1–12.4 or the hollow tube 11, or both, to a temperature sufficient for direct adherence of the conductors 12.1–12.4 to the heat-shrinkable material of the inner surface 11.1 of the hollow tube 11 while the conductors 12.1–12.4 are contacting the inner surface 11.1 of the tube 11 and are being held in place by a metal or ceramic mandrel.

Figure 2:
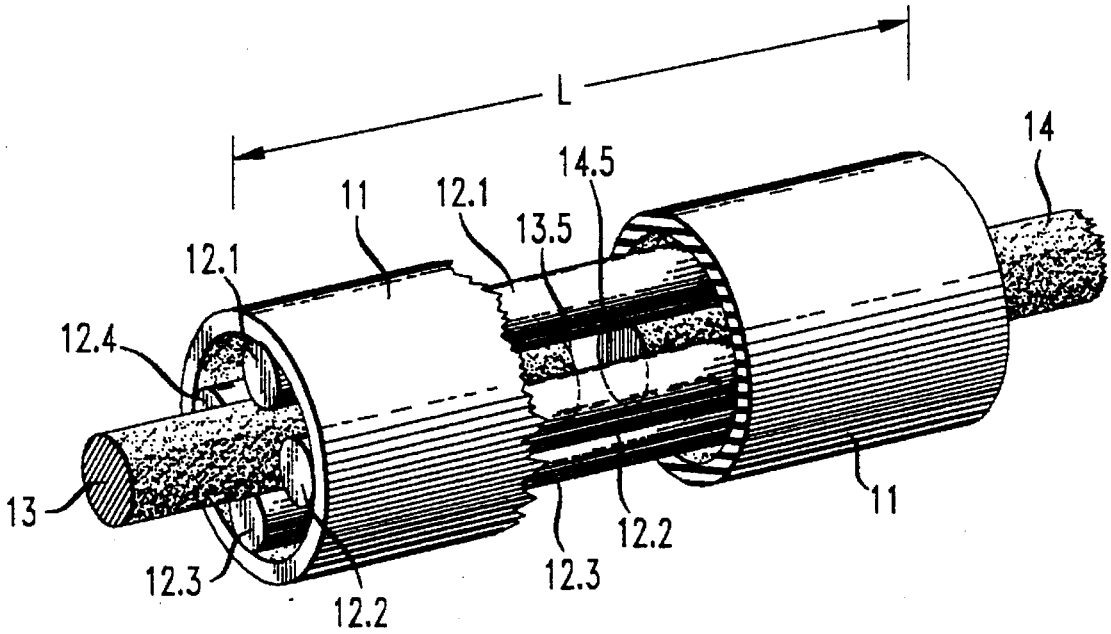
FIG. 2 shows a perspective view, partly cut away and partly in cross section, of a pair of wires that have been connected together in the device shown in FIG. 1, in accordance with a specific embodiment of the invention.

Advantageously each of these four conductors runs substantially parallel to the axis of the hollow tube 11. Also, each of the conductors 12.1–12.4 typically runs along substantially the entire length L of the tube 11. Wires 13 and 14 (FIG. 2) are to be joined together after their being inserted into opposite open ends of the tube 11, as described in greater detail below.

Advantageously each of the four conductors 12.1, 12.2, 12.3, and 12.4 is made of copper, tin, or gold. The diameter of each of these conductors 12.1–12.4 advantageously is less than approximately one-third the inner diameter of the hollow tube 11 (i.e., the diameter of the inner surface 11.1). Thus there is at least enough empty space between opposing conductor pairs—namely between opposing conductor pair 12.1 and 12.3, and between conductor pair 12.2 and 12.4—for the insertion therein of the wires 13 and 14.

In order to enable the wires 13 and 14 to have a low-resistance connection, they are inserted into opposite open ends of the tube 11 with the (near) end surfaces 13.5 and 14.5 of these wires 13 and 14, respectively, either in close proximity with each other (FIG. 2), abutting each other (not shown), or overlapping each other (not shown). After insertion of the wires 13 and 14 into the tube 11 as aforementioned, the tube 11 is heated to a temperature T sufficient to cause the heat-shrink material of this tube 11 to shrink after cooling to such an extent that the conductors 12.1, 12.2, 12.3, and 12.4 collapse and grasp the wires 13 and 14. Advantageously the grasping is with sufficient compressive force to break through at least some of any insulating material that may be present on the surfaces of the wires 13 and 14. In this way, a low-electrical-resistance connection is established between the wires 13 and 14 via the conductors 12.1, 12.2, 12.3, and 12.4. It is enough, of course, that both of the wires 13 and 14 establish low-resistance connections with only one, but each with the same one, of these conductors. For example, the heat-shrink material of the tube 11 is essentially a Teflon- or a vinyl-based material, and the temperature T is approximately 150° F. (=66° C.).

Although the invention has been described in detail in terms of a specific embodiment, various modifications can be made without departing from the scope of the invention. Prior to inserting the wires 13 and 14 into the tube 11, the length of this tube together with the conductors 12.1–12.4 can be considerably longer than the length L, typically at least approximately three times as long as L, and the tube together with the conductors can be cut into one or more pieces, each having a length approximately equal to L, when it is decided how long a length L is desired for each of the piece(s) to accommodate the demands of the task(s) at hand. Also, instead of four conductors 12.1, 12.2, 12.3, 12.4, there can be more than four or as few as one, but preferably at least three.

Figure 3:
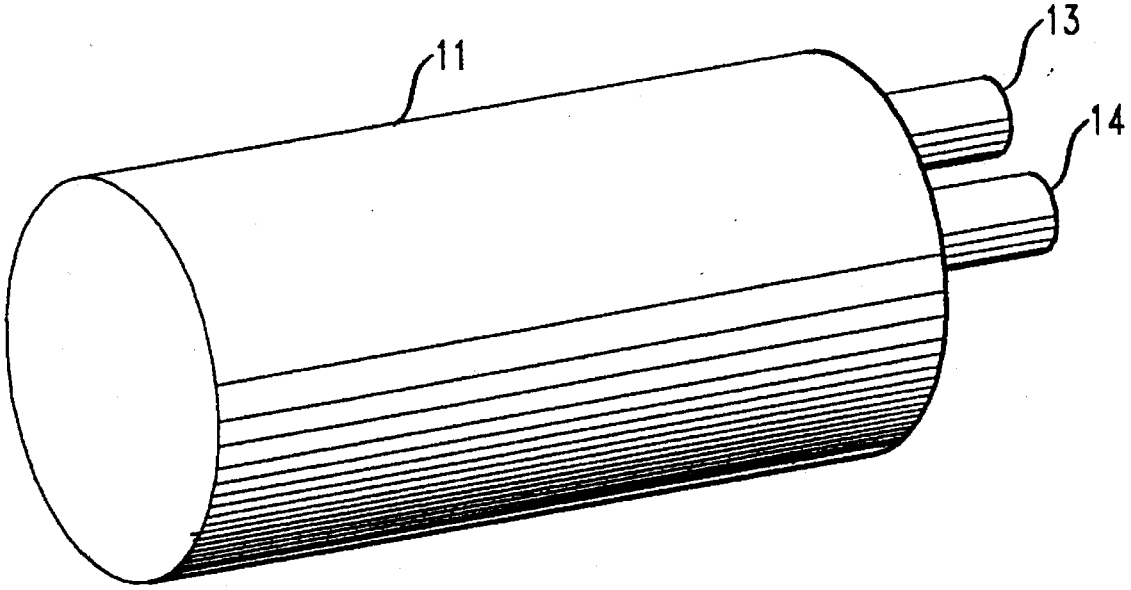
FIG. 3 shows a perspective view of an alternative embodiment showing a crimping device having an open end and an opposed closed end having a conductive plug.
Figure 4:
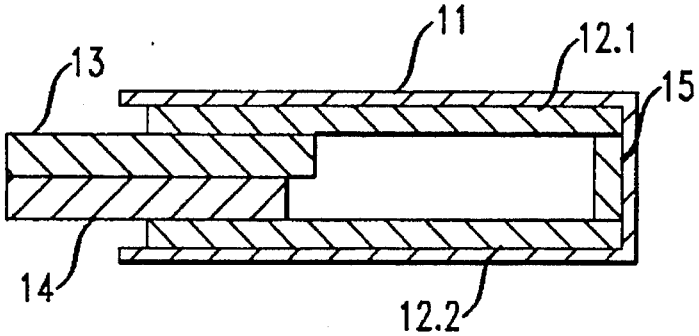
FIG. 4 shows a cross-sectional view of the alternative embodiment.

One or both of the wires 13, 14 can be coated with an insulator layer (not shown) in regions outside the tube 11. Also, the two wires can be inserted into one and the same end of the tube as shown in FIGS. 3–4. In such a case, the other end of the heat-shrinkable tube advantageously is closed, instead of being open, and contains an electrically conductive metallic plug 15 at the closed end at least three (substantially parallel) conductors 12.1 12.2, etc. extend over a separate peripheral portion of the plug 15. Thereby each of the conductors spaces apart a separate peripheral portion of the plug from a separate portion of the inner cylindrical surface of the hollow tube 11 at its closed end. In this way, each of the conductors contacts at least one of the wires and connect the two wires together via the plug, thereby providing a lower resistance connection between the two wires via these conductors and the plug.

I claim:

1. A method of establishing a low electrical resistance between first and second wires comprising the steps of:

(a) providing a heat-shrinkable hollow tube on whose inner surface is attached at least one conductor, the hollow tube having a length L and at least a first open end and an axis, the at least one conductor running substantially parallel to the axis;

(b) inserting the first wire into the first open end and the second wire into either the first open end or a second opposite open end of the tube; and (c) heating the heat-shrinkable hollow tube to a sufficiently high temperature whereby, on cooling, the inner diameter of the tube is reduced and the tube forces the at least one conductor to grasp the first and the second wires firmly.

2. The method of claim 1 further comprising, prior to step (a), the step of providing a longer heat-shrinkable hollow tube with one or more longer conductors attached to said inner surface thereof and running substantially parallel with the axis, both the longer tube and the one or more longer conductors having lengths that are at least approximately three times as long as L, and cutting off a piece having the length L from the longer tube together with the one or more longer conductors located on the inner surface thereof to form the heat-shrinkable hollow tube.

3. The method of claim 1 in which at least three conductors are attached to the inner surface of the hollow tube, said at least three conductors running substantially parallel to the axis of the tube.

4. The method of claim 1 in which the at least one conductor is essentially copper.

5. The method of claim 1 in which the at least one conductor is essentially tin.

6. The method of claim 1 in which the at least one conductor is essentially gold.

7. The method of claim 1 wherein step (b) includes inserting the second wire into the first open end.

8. The method of claim 7 wherein step (a) provides a conducting plug at the second open end to close the second end, the conducting plug electrically connecting with said at least one conductor.

9. The method of claim 1 wherein step (a) includes providing the at least one conductor axially along substantially the entire length L of the hollow tube.

10. The method of claim 9 wherein step (b) inserts the first wire and the second wire into the hollow tube until an end of the respective first wire and second wire substantially abut.

11. The method of claim 9 wherein step (b) inserts the first wire and the second wire into the hollow tube until an end of the respective first wire and second wire overlap.

12. A device for establishing a low electrical resistance between at least two wires comprising a heat-shrinkable hollow tube having at least one open end, an axis and a length L on whose inner surface is attached at least one conductor running substantially parallel to the axis along substantially the entire length L of the tube, the device being capable of making a low resistance connection with said two wires contained therein through reduction in the diameter of the heat-shrinkable hollow tube and forcing of the at least one conductor into electrical contact with the two wires.

13. The device of claim 12 in which the at least one conductor is essentially tin.

14. The device of claim 12 in which the at least one conductor is essentially gold.

15. The device of claim 12 in which the at least one conductor is essentially copper.

16. The device of claim 12 in which the hollow tube has a closed end and only one open end, the hollow tube containing an electrically conducting plug at the closed end and containing at least three conductors running substantially parallel to the axis of the hollow tube, each of the at least three conductors being attached to the inner surface of the hollow tube and extending to separate, spaced apart peripheral portions of the plug, the plug electrically connecting each of the at least three conductors together.

17. The device of claim 16 in which the conductors are essentially tin.

18. The device of claim 16 in which the conductors are essentially gold.

19. The device of claim 16 in which the conductors are essentially copper.

* * * * *